US009103233B2

(12) United States Patent
Shapiro et al.

(10) Patent No.: US 9,103,233 B2
(45) Date of Patent: Aug. 11, 2015

(54) METHOD AND APPARATUS FOR IMPROVING ELECTRO-HYDRAULIC AND ELECTRO-MECHANICAL INTEGRATED CONTROL SYSTEMS OF A STEAM TURBINE

(71) Applicant: Statistics & Control, Inc., West Des Moines, IA (US)

(72) Inventors: Vadim Shapiro, Clive, IA (US); Pusin Boris, West Des Moines, IA (US)

(73) Assignee: Statistics & Control, Inc., West Des Moines, IA (US)

( * ) Notice: Subject to any disclaimer, the term of this patent is extended or adjusted under 35 U.S.C. 154(b) by 68 days.

(21) Appl. No.: 13/798,437

(22) Filed: Mar. 13, 2013

(65) Prior Publication Data

US 2014/0260249 A1 Sep. 18, 2014

(51) Int. Cl.

| | |
|---|---|
| ***F01K 13/02*** | (2006.01) |
| ***F01K 13/00*** | (2006.01) |
| ***F01D 21/00*** | (2006.01) |
| ***F01D 21/14*** | (2006.01) |

(52) U.S. Cl.

CPC ..... *F01K 13/003* (2013.01); *F01D 21/00* (2013.01); *F01D 21/14* (2013.01); *F01K 13/02* (2013.01)

(58) Field of Classification Search

CPC ..... F01K 13/003; F01K 13/02; F01D 21/14; F01D 21/00

USPC ..... 60/646, 657; 307/64–68

See application file for complete search history.

(56) References Cited

U.S. PATENT DOCUMENTS

| | | | | |
|---|---|---|---|---|
| 3,097,488 | A * | 7/1963 | Eggenberger et al. | 415/15 |
| 4,254,344 | A * | 3/1981 | Fancy et al. | 307/86 |
| 4,398,393 | A | 8/1983 | Ipsen | |
| 5,346,360 | A | 9/1994 | Cooper | |
| 5,422,808 | A * | 6/1995 | Catanese et al. | 700/79 |
| 6,116,258 | A * | 9/2000 | Shapiro et al. | 137/1 |
| 6,192,687 | B1 * | 2/2001 | Pinkerton et al. | 60/646 |
| 6,719,523 | B2 | 4/2004 | Staroselsky et al. | |
| 6,767,178 | B2 | 7/2004 | Staroselsky et al. | |
| 7,194,865 | B2 | 3/2007 | Drob | |
| 7,669,419 | B2 * | 3/2010 | Juby et al. | 60/646 |
| 7,747,356 | B2 * | 6/2010 | Andarawis et al. | 700/292 |
| 2004/0081549 | A1 * | 4/2004 | Shapiro et al. | 415/1 |
| 2007/0022755 | A1 * | 2/2007 | Pinkerton et al. | 60/646 |

* cited by examiner

*Primary Examiner* — Hoang Nguyen

(74) *Attorney, Agent, or Firm* — McKee, Voorhees & Sease, PLC

(57) ABSTRACT

A means to effect a trip response regardless of the electro-mechanical actuator type used for improving electro-hydraulic and electro-mechanical integrated control systems for a steam turbine. To achieve this goal, electro-mechanical actuators can be equipped with multiple coils or multiple motors (usually a primary and a secondary). In a dual-coil configuration, the primary is energized according to an output of a PID controller, whereas the secondary coil is regulated by a separate control element. The entire system is powered by means of Uninterruptable Power Supply (UPS) with AC output which can provide sufficient time for trip response using primary coil or motor. At the same time, secondary coil or motor is powered by independent power from a UPS and/or separate battery backup. Whenever trip response is required, and there is a complete main power interruption secondary coil or motor is quickly energized to provide adequate trip response.

8 Claims, 5 Drawing Sheets

METHOD AND APPARATUS FOR IMPROVING ELECTRO-HYDRAULIC AND ELECTRO-MECHANICAL INTEGRATED CONTROL SYSTEMS OF A STEAM TURBINE

FIELD OF THE INVENTION

The present invention generally relates to a method and apparatus for increasing the operational reliability and preferably the safety of a steam turbine's electro-hydraulic control system or electro-mechanical control system with respect to the process of turbine shutdown.

BACKGROUND OF THE INVENTION

Steam turbine control systems often incorporate electro-mechanical pilot-valve actuator assemblies to regulate hydraulically-driven actuator pistons that modulate steam valves, thereby controlling turbine speed. However, it is becoming more popular to use direct electro-mechanical actuation of the steam valves themselves, since they are fully capable of satisfying force and speed requirements.

In case of electro-mechanical pilot-valve actuation, some of the prior art systems can be applied to provide trip response upon complete power interruption. In case of the direct actuation of the steam valve, however, using electro-mechanical actuators, a complete interruption of electrical power to the electromotor makes this solution unusable in some industries, especially in power utility industries where the requirement is that there be a trip response of the steam valves for many circumstances. The application of the prior art systems, though is technically impractical.

For example, it is well known that the drawback of electromagnetic actuation is that on brief interruptions of electrical power, the actuator causes a trip response to the pilot valve, whereas a drawback of electromotor actuation is that on complete interruptions of electrical power the actuator cannot independently cause a trip response of the pilot valve on demand.

Thus, there is a need for a method and apparatus to provide a trip response of electrically actuated steam turbine control valves in the case of primary electrical power source interruption or failure of any primary control system electrical component.

FEATURES OF THE INVENTION

A general feature of the present invention is a method and apparatus for improving electro-hydraulic and electro-mechanical integrated control systems for a steam turbine that addresses the problems in the art.

A further feature of the present invention is a method and apparatus for improving electro-hydraulic and electro-mechanical integrated control systems for a steam turbine that provides a means to effect a trip response regardless of the electro-mechanical actuator type used.

Another feature of the present invention is a method and apparatus for improving electro-hydraulic and electro-mechanical integrated control systems for a steam turbine that overcomes the drawbacks of electromotor actuation.

A still further feature of the present invention is a method and apparatus for improving electro-hydraulic and electro-mechanical integrated control systems for a steam turbine that combines the capabilities of effecting a trip response regardless of the electro-mechanical actuator type used and the drawback of electromotor actuation.

Still yet another feature of the invention is a method and apparatus for improving electro-hydraulic and electro-mechanical integrated control systems for a steam turbine that provides a trip response of electrically actuated steam turbine control valves in the case of primary electrical power source interruption or failure of any primary control system electrical component.

Another feature of the present invention is a method and apparatus for improving electro-hydraulic and electro-mechanical integrated control systems for a steam turbine that is simpler than prior art systems.

These and other features or objects of the invention will be addressed further in the remaining descriptions contained herein.

SUMMARY OF THE INVENTION

The present invention generally drives steam turbine control valves to a closed position in case of primary power supply interruption in a manner which overcomes the problems associated with the prior art. More specifically, the present invention preferably employs an additional electromotor connected to mechanical actuators and supplementary equipment such as one or more additional digital controllers and battery backup. Also some prior art systems suggested using double coil motors (or a second motor) only to increase the force applied during dynamic control action and to improve control system dynamic characteristics. However, the present invention incorporates implementation of double coil (two motors) actuation for protection purposes. The second coil (motor) is used as a backup actuator in case of primary power source interruption or failure of any primary control systems electrical component.

Generally, in the present invention, when an electromotor actuator is coupled to an additional piston and working in conjunction with a pilot valve, or is coupled directly with the steam valve, the combined effect is still capable of providing electrical trip to shut down the turbine on demand during complete electrical service interruptions. All control system components are preferably fully backed up, including electrical motor, position transmitter, controller, power supply, and cables. The present invention generally includes electro-mechanical actuators that can be equipped with multiple coils (usually a primary and a secondary). In a dual-coil configuration, the primary coil is preferably energized according to an output of a PID controller, whereas the secondary coil is preferably regulated by a separate control element.

The entire system is preferably powered by means of Uninterruptable Power Supply (UPS) with AC output which can provide sufficient time for trip response using a primary coil. At the same time, a secondary coil is preferably powered by an independent source (AC or DC) supported by a UPS and/or a separate battery backup. Thus, whenever trip response is required and there is a complete main power interruption, the secondary coil is quickly energized to provide the necessary trip response.

Consequently, the present invention negates the disadvantage of using electromotor actuators particularly in power utility industry, but also provides higher reliability of the integrated turbo machinery speed-control system.

Prior art systems described independent protection system using hydraulic components which overcomplicates the control system setup, and reduce system reliability. The advantage of the present invention over prior art is it does not require complex implementation of independent hydraulic protection system and uses pure electro-mechanical components.

DETAILED DESCRIPTION OF THE PREFERRED EMBODIMENTS

To provide reliable trip response at the event of complete power interruption from the main source an integrated turbo machinery control system should be capable of compensating that by providing power to the secondary motor from the secondary uninterruptable power source, through secondary drive.

Figure 1:
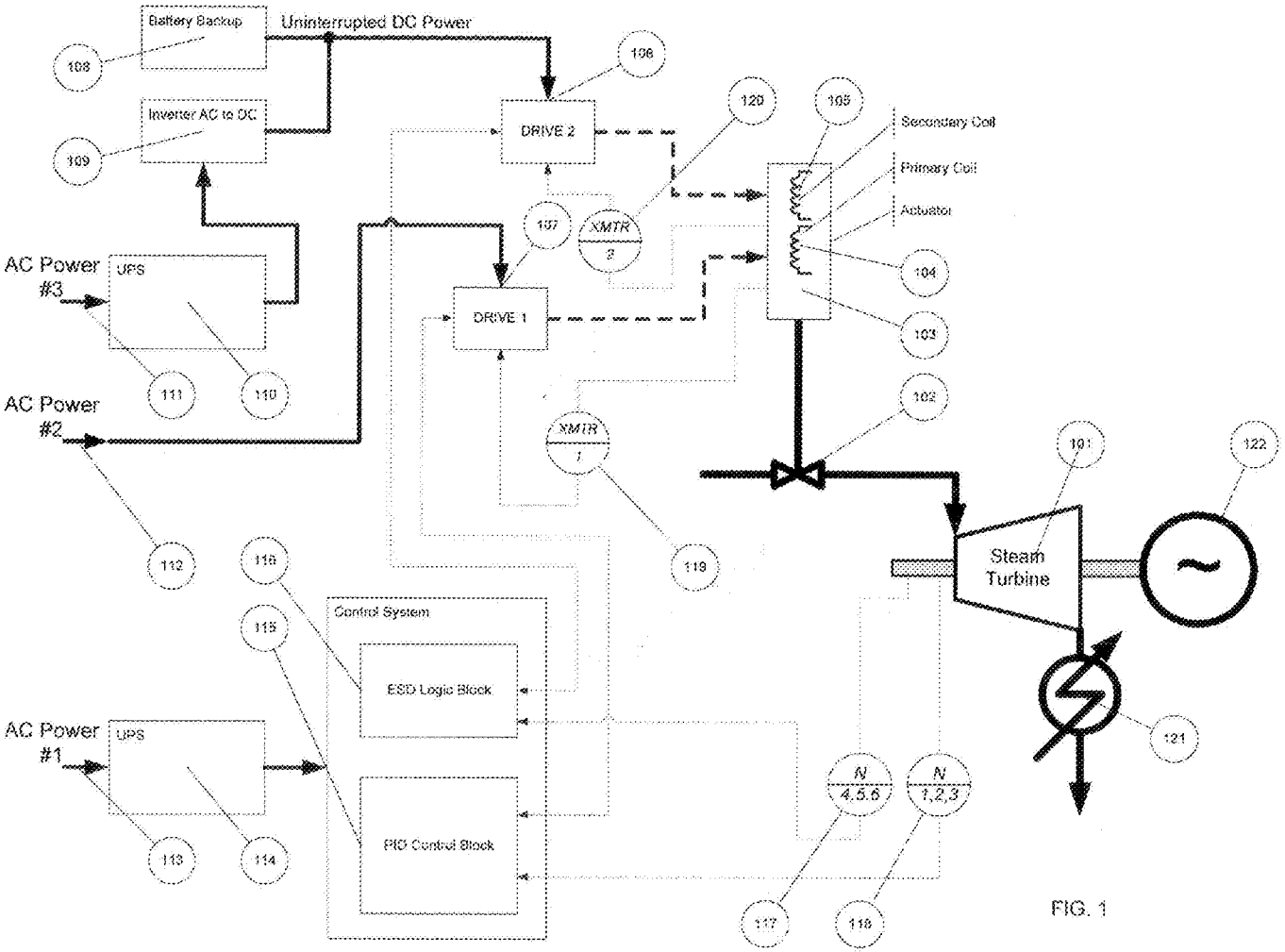
FIG. 1 shows an integrated, turbo machinery speed-control system with a pilot-valve actuator assembly comprising two electromagnetic coils.

FIG. 1 shows a steam turbine 101 complete with integrated control system incorporating a rotational-speed PID control block 115 that control rotational speed of the turbine, in addition to monitoring rotational-speed measurements obtained by a speed transmitters (N 1,2,3) 118, which consequently processed in integrated control system to provide process variable for PID control block 115. This PID control block 115 sends set point reference value to the Drive 1 107, which control position of the steam valve actuator 103 in addition to monitoring position of the steam valve position from transmitter (XMTR 1) 119. The steam-valve actuator 103 is connected to a steam valve 102 used to regulate the flow of steam passing through the turbine 101. When steam exits the turbine, it passes into a condenser 121 or other process; additionally, the turbine is used to drive a load 122 (shown as a generator), but this invention is not restricted to a particular load.

Power to Control System is provided from the main source AC Power #1 113 through the uninterruptable power supply (UPS) 114. Power to the Drive 1 107 is provided from the main source AC Power #2 112, which consequently powers primary coil of the actuator 104.

FIG. 1 also shows Emergency Shutdown Logic Block (ESD) 116 as a part of the integrated control system, which monitors the speed of the steam turbine 101 by receiving signal from transmitters (N 4,5,6) 117, which consequently process in ESD Logic Block 116 by two-out-of-three voting elements. ESD Logic Block 116 also monitors main power loss AC Power #2 112.

At the normal operating conditions trip response provided by closing of the steam valve 102 through changing set point reference value to 0 for the Drive 1 107, which consequently manipulates primary coil of the actuator 103 and closes the steam valve 102.

Also at the normal operating conditions Drive 2 106 is monitors position of the steam valve by receiving signal from transmitter (XMTR 2) 120.

Drive 2 106 powered by DC power and provided either from the main source AC Power #3 111 through uninterruptable power supply (UPS) 110, and consequently AC/DC converter or alternately from battery backup 108.

Whenever ESD logic Block 116 senses main source power loss it instantaneously changes set point reference value to the Drive #2 106 to 0, which consequently manipulates secondary coil of the actuator 105 and closes the steam valve 102.

Figure 2:
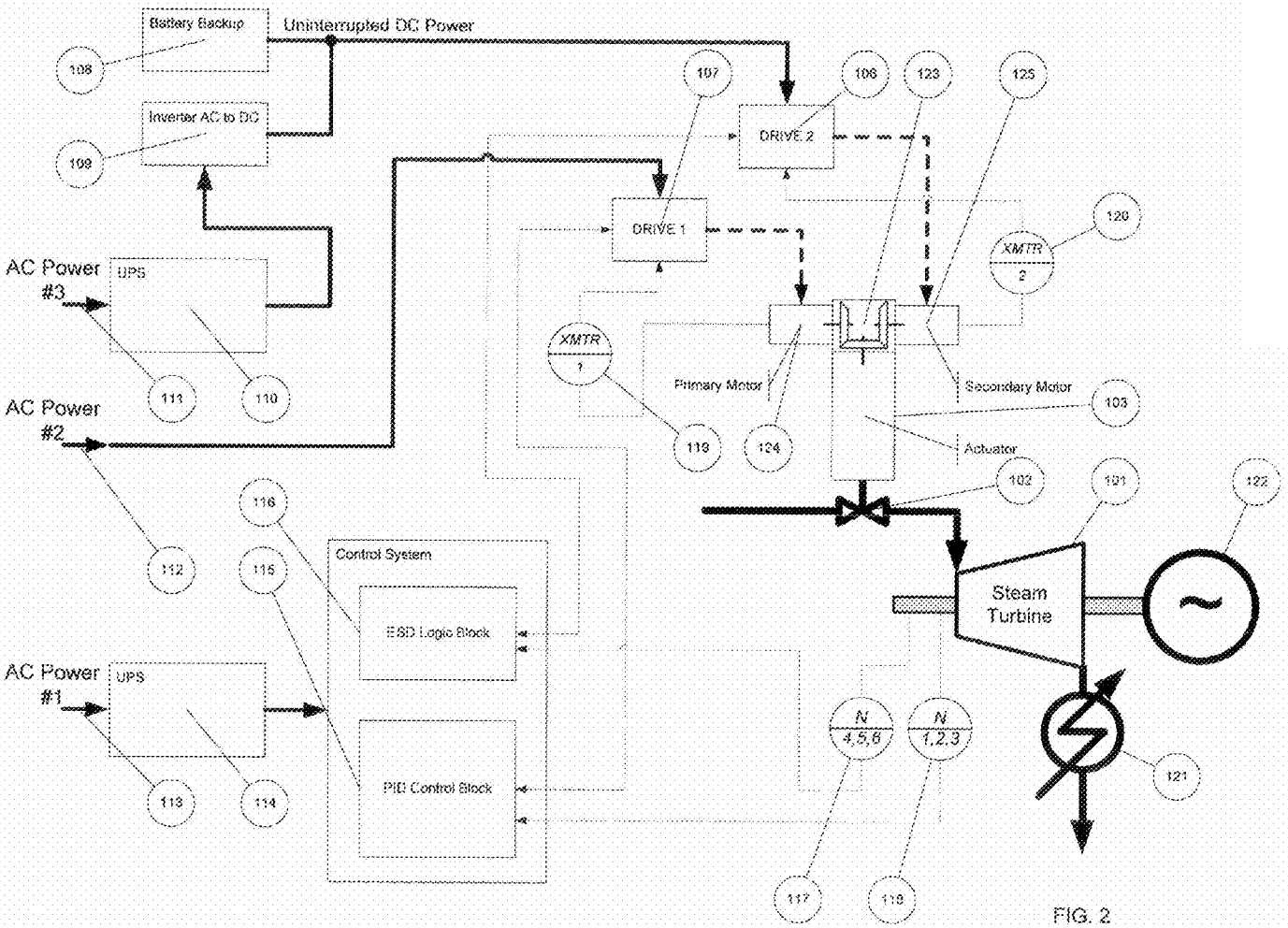
FIG. 2 shows an integrated, turbo machinery speed-control system with a direct steam actuator assembly comprising two electromagnetic coils.

All of the above is applicable to the FIG. 2 with an exception that electro-mechanical actuator 103 instead of motor with multiple coils equipped with gear box 123 and two motors primary motor 124 and secondary motor 125, which provides trip response by closing steam valve 102 through been energized by uninterruptable DC power from AC/DC inverter 109, or alternatively from battery backup 106.

Figure 3:
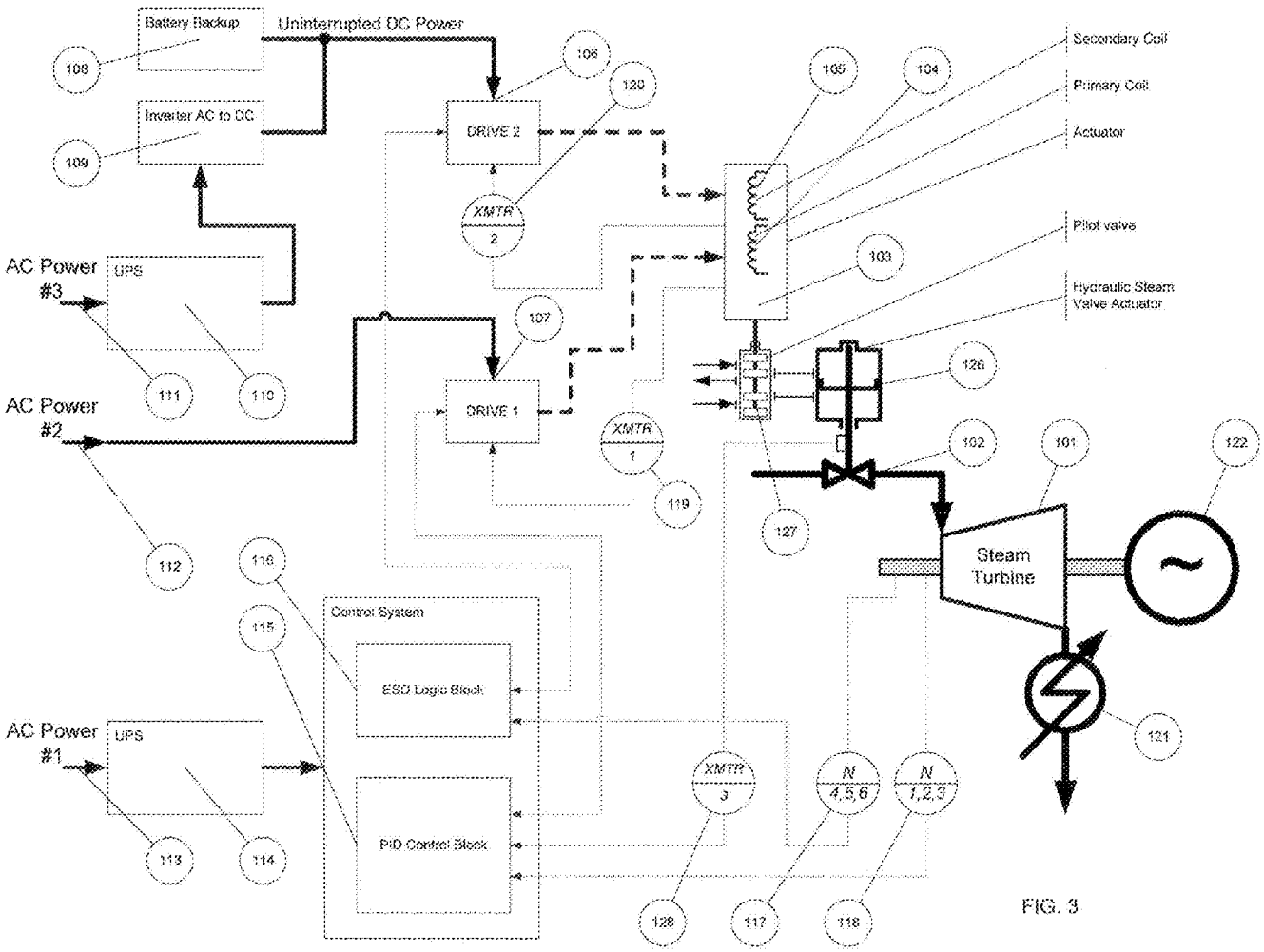
FIG. 3 shows an integrated, turbo machinery speed-control system with a pilot-valve actuator assembly comprising two electric motors.

FIG. 3 similarly to FIG. 1 shows a steam turbine 101 complete with integrated control system incorporating a rotational-speed PID control block 115 that control rotational speed of the turbine, in addition to monitoring rotational-speed measurements obtained by a speed transmitters (N 1,2,3) 118, which consequently processed in integrated control system to provide process variable for PID control block 115. This PID control block 115 sends set point reference value to the Drive 1 107, which control position of the pilot valve 127 actuator 103 in addition to monitoring position of the pilot valve position from transmitter (XMTR 1) 119, additionally PID control block 115 monitors position of the steam valve by receiving transmitter (XMTR 3) 126. The actuator 103 is connected to a pilot-valve 127, which through hydraulic actuator 126 regulate the flow of steam passing through the turbine 101. When steam exits the turbine, it passes into a condenser 121 or other process; additionally, the turbine is used to drive a load 122 (shown as a generator), but this invention is not restricted to a particular load.

Figure 5:
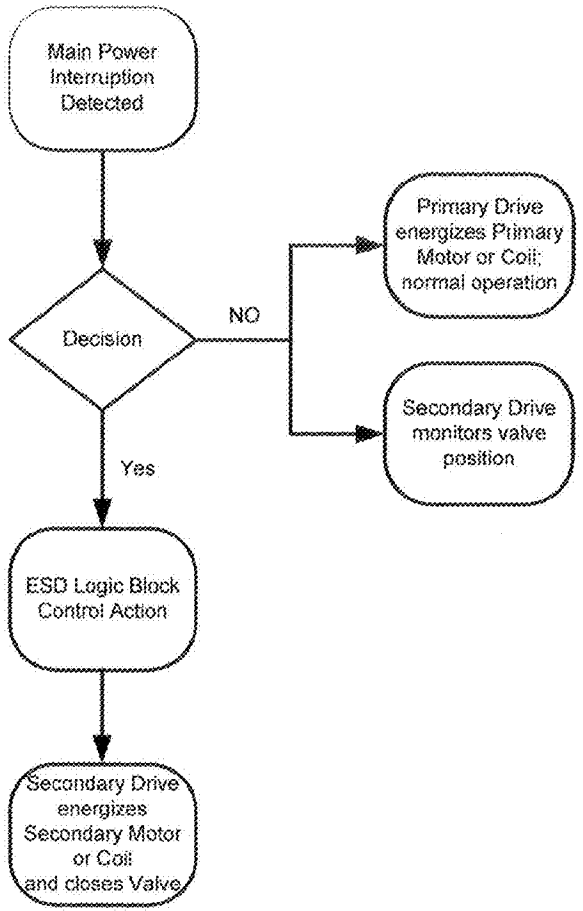
FIG. 5 depicts the logic diagram for integrated control system actions in case of complete main power interruption.

As explained above and shown on FIG. 5, whenever ESD logic Block 116 senses main source power loss it instantaneously changes set point reference value to the Drive #2 106 to 0, which consequently manipulates secondary coil 105 of the actuator 103, move pilot-valve 127 to the appropriate position and consequently closes the steam valve 102.

Figure 4:
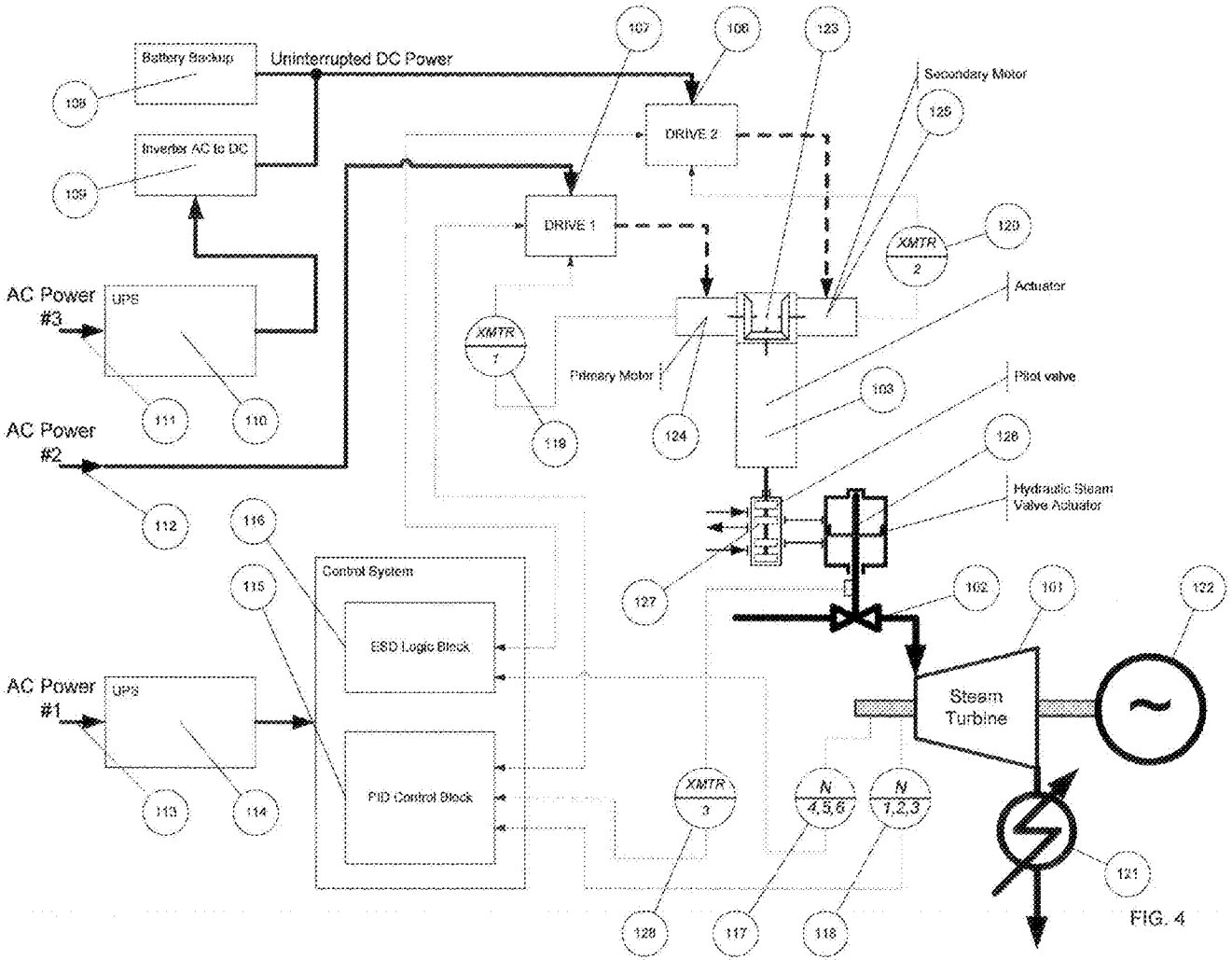
FIG. 4 shows an integrated, turbo machinery speed-control system with a direct steam actuator assembly comprising two electric motors.

All of the above is applicable to the FIG. 4. with an exception that electro-mechanical actuator 103 instead of motor with multiple coils 104 and 105 equipped with gear box 123 and two motors primary motor 124 and secondary motor 125, which provides trip response by moving pilot-valve 127 to the appropriate position and consequently closes the steam valve 102 through been energized by uninterruptable DC power from AC/DC inverter 109, or alternatively from battery backup 106.

The turbine-controlled variable described herein is not restrictive nor unique to this invention; in which case, other control-system variables may be considered. However, it should be noted that the type of electro-mechanical actuators is immaterial as long as they are equipped with multiple coils or motors, and corresponding drivers. This invention has many applications wherever electro-mechanical actuators are used. Obviously, many modifications and variations of the present invention are possible in light of the above teachings. It is, therefore, to be understood that within the scope of the appended claims, the invention may be practiced otherwise than as specifically described.

What is claimed is:

1. A method for providing reliable trip response on an integrated steam turbine control system, the system including a hydraulic steam-valve actuator with more than two positions, an instrumentation providing a signal proportional to a steam-valve actuator's position, a pilot valve for manipulating a position of the steam-valve actuator's piston, an electro-mechanical pilot-valve actuator containing at least two individually-energized coils including a primary coil and a secondary coil, at least two electric motors, an Uninterruptable Power Supply (UPS), primary and backup control systems and battery power backup, the method comprising:

providing power to the electro-mechanical pilot-valve actuator primary coil from a main source;

providing power to the electro-mechanical pilot-valve actuator secondary coil from a secondary source if power to the primary coil is lost;

sensing main power loss and sensing trip request; and sending a signal to at least one individually energized coil within the electro-mechanical pilot-valve actuator to provide an adequate trip response.

2. The method of claim 1, wherein the power loss signal is sensed and provided to an emergency shutdown logic block within the integrated steam turbine control system.

3. The method of claim 1, wherein the integrated steam turbine control system receives or generates a trip request.

4. The method of claim 1, wherein AC power is used for normal operating conditions, and backup power is used whenever complete loss of power from the main source occurred.

5. The method of claim 4, wherein the secondary coil is not executing a control action whenever an AC power from the main source is present.

6. The method of claim 4, wherein the secondary coil is only energized by backup power.

7. A method for providing reliable trip response on an integrated steam turbine control system, the system including a hydraulic steam-valve actuator with more than two positions, an instrumentation providing a signal proportional to a steam-valve actuator's position, a pilot valve for manipulating a position of the steam-valve actuator's piston, an electro-mechanical pilot-valve actuator containing a hydraulic steam valve actuator and pilot-valve, a direct electro-mechanical actuator including at least two drives to the steam valve, and at least two electric motors, an Uninterruptable Power Supply (UPS), primary and backup control systems and battery power backup, the method comprising:

energizing a first drive in the electro-mechanical actuator from a first source;

energizing a second drive in the electro-mechanical actuator from a second source;

sensing main power loss and sensing trip request; and sending signal to at least one direct steam valve actuator to provide an adequate trip response.

8. The method of claim 7, wherein the first drive and the second drive are powered from different sources.

* * * * *